US005127695A

United States Patent [19]

Zoeten

[11] Patent Number: 5,127,695

[45] Date of Patent: Jul. 7, 1992

[54] APPARATUS FOR MANIPULATING A PALLET

[75] Inventor: Elbert Zoeten, Heiloo, Netherlands

[73] Assignee: Hoogovens Groep BV, Ijmuiden, Netherlands

[21] Appl. No.: 533,459

[22] Filed: Jun. 5, 1990

[30] Foreign Application Priority Data

Jun. 16, 1989 [NL] Netherlands ..... 8901522

[51] Int. Cl.[5] ..... B66C 1/10

[52] U.S. Cl. ..... 294/67.33; 294/119.1

[58] Field of Search ..... 294/67.2, 67.3, 67.33, 294/81.54, 81.62, 119.1, 81.6, 81.61

[56] References Cited

U.S. PATENT DOCUMENTS

| | | | |
|---|---|---|---|
| 2,250,273 | 7/1941 | Priester . | |
| 2,462,691 | 2/1949 | Thompson | 294/67.33 X |
| 2,959,445 | 11/1960 | Breslav | 294/67.33 X |
| 3,909,056 | 9/1975 | Duwe | 294/67.33 X |
| 4,453,873 | 6/1984 | Curti | 294/81.62 X |

FOREIGN PATENT DOCUMENTS

| | | | |
|---|---|---|---|
| 242454 | 10/1987 | European Pat. Off. . | |
| 3300801 | 2/1984 | Fed. Rep. of Germany . | |
| 2298504 | 8/1976 | France . | |
| 8503583 | 7/1987 | Netherlands . | |
| 1141064 | 2/1985 | U.S.S.R. | 294/67.2 |
| 2167039 | 5/1986 | United Kingdom . | |

*Primary Examiner*—Russell D. Stormer
*Assistant Examiner*—Dean J. Kramer
*Attorney, Agent, or Firm*—Stevens, Davis, Miller & Mosher

[57] ABSTRACT

An apparatus for manipulating a two-part pallet which includes at least one pair of first and second engagement members displaceable relative to each other along an axis. The first engagement member is provided with a first clamp for clamping a portion of the first pallet part and the second engagement member is provided with a second clamp for clamping a portion of the second pallet part. Actuation of the first clamp on the first engagement member couples the first pallet part to the first engagement member and actuation of the second clamp on the second engagement member couples the second pallet part to the second engagement member. The engagement members may be formed by first and second portions of forks or by legs which engage and clamp the pallet parts.

16 Claims, 6 Drawing Sheets

APPARATUS FOR MANIPULATING A PALLET

FIELD OF THE INVENTION

The invention relates to an apparatus for manipulating a pallet, more particularly to an apparatus for manipulating a pallet adapted for supporting and carrying a product, especially a cylindrical shaped product, e.g. a coil of steel strip, and comprising first and second pallet parts to be secured together.

BACKGROUND OF THE INVENTION AND DESCRIPTION OF THE PRIOR ART

Such a pallet is known from laid-open Dutch patent application NL-A-8503583, the disclosure of which is incorporated herein by reference. Here a pallet is described for packing, loading and transporting coiled products of high weight, for example rolls of steel strip. This pallet, whether or not carrying a product, may be moved with a fork lift truck. However, a disadvantage of using a fork lift truck for handling the pallet is that by itself it is not suitable for fitting the pallet to the product to be carried. In particular, if pallets, as is common practice, are assembled into a stack, manual intervention is necessary to take apart the halves of a pallet taken off the stack in order for the pallet to be fitted to the product to be carried, whose size may vary. Only once this has been carried out can the pallet and the product be secured together.

SUMMARY OF THE INVENTION

An object of the present invention is to provide an apparatus whereby this manual intervention becomes unnecessary and it is then possible to fit a pallet taken from a stack with a product without direct manual intervention. To this end the apparatus in accordance with the invention is characterized in that the apparatus includes coupling means for releasable engagement with the pallet, the coupling means comprising at least one pair of engagement members, the or each pair comprising first and second engagement members which are displaceable relative to each other along an axis, the or each first first engagement member being provided with first clamping means for clamping a portion of the first pallet part and the or each second engagement member being provided with second clamping means for clamping a portion of the second pallet part, whereby actuation of the first clamping means on the or each first engagement member couples the first pallet part to the first engagement member or members and actuation of the second clamping means on the or each second engagement member couples the second pallet part to the second engagement member or members.

In one embodiment of the invention each pair of engagement members is formed by first and second portions of an elongate fork member. Each fork is extendable or retractable by relative displacement of the first and second fork portions in mutually opposite directions along said axis or respective axes. The or each fork is adapted for insertion into a respective channel formed in each pallet part, the channel(s) being adjacent the portions of the pallet parts to be clamped by the first and second clamping means. Preferably, the apparatus has two such forks, which are spaced from each other and are movable relative to each other in mutually opposite directions in a plane containing the axis or axes. These forks may therefore be adjustable in a horizontal plane in such a way that they may be moved towards and away from one another. This allows fine adjustment of the coupling means, so that the apparatus may work accurately with pallets of different sizes. In practice, about five different sizes of pallet may be encountered. Also, this fine adjustment assists accurate positioning of the forks in front of the channels in the pallet.

In this embodiment the first and second clamping means are preferably hooks which are engageable with respective portions of the first and second pallet parts, each hook being pivotable about a respective pivot carried by its respective engagement member. The pivoting of each hook is controllable by a respective pressure cylinder. The fork or forks may also be provided with an enlargement portion adjacent each pivot, for cooperating with a respective hook to increase the clamping action of the hooks with the respective portions of the pallet parts when the hooks are pivoted. It is also preferable that the fork or forks are movable in a direction substantially perpendicular to a plane containing said axis or axes by means of a pneumatic pressure system. This enables much more accurate positioning of the apparatus in a vertical direction than can be achieved with other drive systems.

In another embodiment of the invention each of the engagement members is a leg, the legs of each pair being movable relative to each other in a direction along said axis or respective axes. Each leg carries, preferably near its foot, a clamping means, which are for example actuatable by respective pressure cylinders. Preferably there are two pairs of legs, each pair being spaced from the other and movable relative to the other in mutually opposite directions in a plane containing said axis or axes. The means for effecting the relative movement of the various legs is preferably provided by a system of slide bars and screw rods interconnecting the various components. The whole mechanism may be mounted in a frame or box or in any other suitable means.

For example, the two legs of a pair may be movable relative to each other by means of a first mechanism comprising at least one screw rod having two oppositely threaded portions, one of which portions carries the first leg and the other of which portions carries the second leg, each of the legs being slidable along a slide bar, wherein rotation of the screw rod or rods in a given direction causes the first and second legs to slide towards one another along their respective slide bars and rotation of the screw rod or rods in an opposite direction causes the first and second legs to slide away from one another along their slide bars. Similarly, different pairs of legs may be moved relative to one another by means of a second mechanism which is substantially the same as the first, but arranged to act in a direction 90° to the first mechanism. Preferably, the coupling means is supported on one bar of a C-frame, which bar is angularly displaceable with respect to the C-frame.

It is desirable that the apparatus in accordance with the invention has sufficient freedom of movement so that it may move in a variety of different directions, in order to be versatile for the manipulation and moving of pallets and products to be supported thereby. Preferably, the coupling means of the apparatus is carried on a manipulating arm which is movable in substantially any direction. The driving force for the various movements of parts of the apparatus, i.e. clamping means, engagement members, screw rods etc., may be obtained in various ways, for example by electro-mechanical drive or drive using hydraulic or pneumatic pressure cylinders and a corresponding pressure generating unit. Such devices are well known in the art.

It will be appreciated that with this second embodiment of the apparatus it is necessary to engage and clamp the pallet from the side opposite to that which is to contact and support the product, i.e. the side opposite to the side having the peripheral rim or flange, as shown in NL-A-8503583. Thus, in use the second embodiment of the invention requires that the pallets to be manipulated are stacked upside down.

BRIEF DESCRIPTION OF THE DRAWINGS

Embodiments of the invention will now be described in detail, by way of example only, with reference to the accompanying drawings, wherein.

DETAILED DESCRIPTION OF EMBODIMENTS OF THE INVENTION

Figure 1:
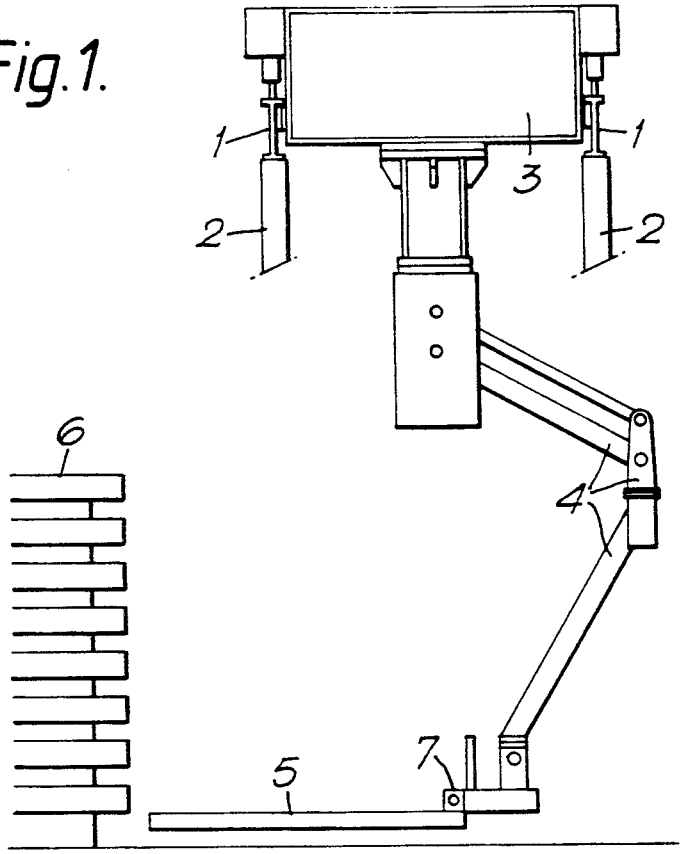
FIG. 1 shows schematically a first embodiment of the apparatus in accordance with the invention.
Figure 2:
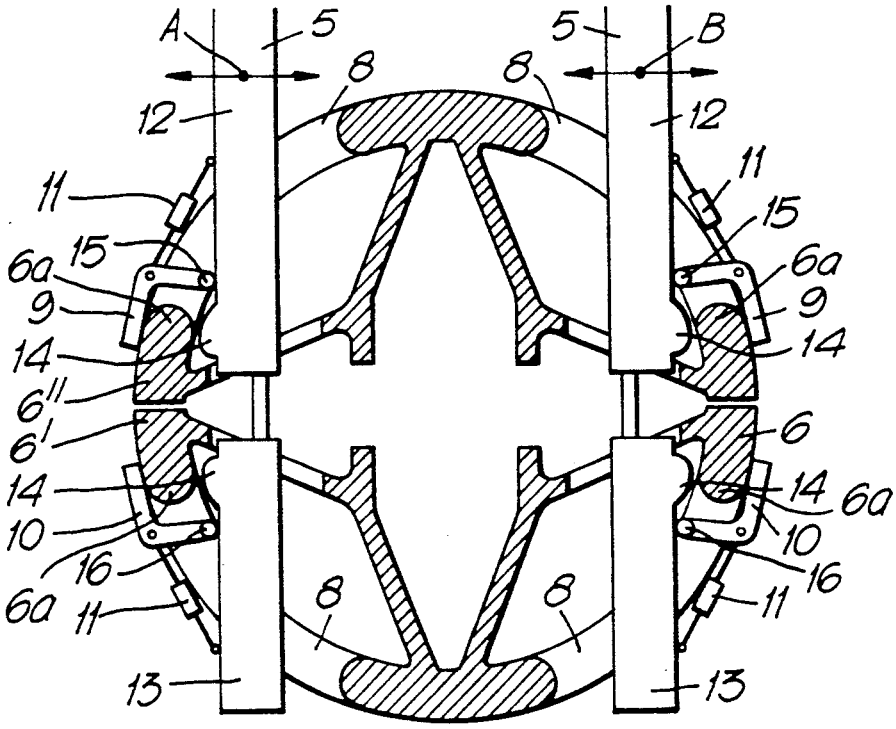
FIG. 2 shows in detail a horizontal section through part of the apparatus of FIG. 1.

Referring firstly to FIGS. 1 and 2, a travelling car 3 is movable along rails 1 which are supported off the ground by means of uprights 2. An apparatus in accordance with this embodiment is suspended from the car 3. The apparatus comprises a system of arms and legs 4 with which the forks 5 may be moved in a vertical direction, as well as in a horizontal direction to and from a stack of pallets 6. The forks 5 can hinge around hinging points 7 preferably in both horizontal and vertical planes, which enables fine adjustment so that the forks 5 may be placed accurately into channel shaped holes 8 of one of the pallets 6. The pallets 6 are fully described in laid-open Dutch patent application NL-A-8503583, so will not be described further here.

There are preferably two forks 5 for uniformly supporting the pallet 6 (see FIG. 2). Each pallet 6 consists of two halves 6′ and 6″ and is provided with channel shaped holes 8. The forks 5 are pushed through these holes 8.

The forks 5 adjust in the horizontal plane in such a way that they may be moved towards and away from one another (as indicated by arrows A and B in FIG. 2). This enables fine adjustment so that the apparatus may work accurately with pallets 6 of different sizes. In practice, about five different sizes of pallet 6 may be handled. Also, this fine adjustment assists accurate positioning of the forks 5 in front of the channel shaped holes 8 of the pallet 6.

In FIG. 2 the forks 5 are shown in their extended position whereby clamping means 9 and 10 couple respectively pallet part 6″ and pallet part 6′ of the pallet 6 with the two forks 5. The clamping means 9 and 10 preferably engage peripheral portions 6*a* of the walls of the pallet parts, which define the channels 8. To this end, each fork 5 consists of two parts 12 and 13 which are movable in and out relative to one another. The clamping means 9 are fitted to the first parts 12 of the forks 5 and the clamping means 10 are fitted to the second parts 13 of the forks 5. The clamping means 9,10 are fixed so that they hinge on the forks 5 and hinge around hinging points 15,16. The hinging is effected by operation of pressure cylinders 11 acting on the clamping means 9,10. To accomplish this, one end of each pressure cylinder 11 is attached to the clamping means 9,10, with the other ends attached to the fork parts 12,13 where the hinging points 15,16 are located. The forks 5 are pushed into the channel shaped holes 8 initially, for example, in their fully retracted condition, whereupon the forks 5 may be extended and the clamping means 9,10 are brought into the condition shown in FIG. 2 by activation of pressure cylinders 11, whereby coupling of the pallet halves 6′ and 6″ to the forks 5 is effected.

The forks 5 are further provided with enlargements 14 which can work together with the clamping means 9,10 in order to clamp the pallet halves 6′,6″ more securely to the fork parts 13 and 12, respectively.

Further extension of the fork parts 12 and 13 moves the pallet parts 6′ and 6″ of the pallet 6 apart, enabling the pallet to be fitted to a roll-shaped product to be carried, such as a coil of strip steel. After the pallet 6 is fitted to the product to be carried the fork parts 12 and 13 may be slightly retracted again, sufficiently to allow the pallet 6 to be clamped onto the product to be carried. As seen in NL-A-8503583, the periphery of the pallet preferably comprises a raised rim or flange for gripping the product.

Apart from the forks 5 being able to be finely adjusted by hinging around hinging points 7 to enable insertion into the channel shaped holes 8, it is also desirable that the apparatus be provided with pneumatic drive means for moving the forks, with or without the load, in a vertical direction. This drive means makes it possible to easily adjust the apparatus accurately in insertion height more finely than for example with a hydraulic drive system, and also to allow the pallet halves 6′ and 6″ to be positioned accurately against the product to be carried.

Hinging of the forks around hinging points 7 in a vertical plane allows the apparatus to take a pallet from the top of a stack and to fit it to an end or side of a product, however oriented, e.g. an end of a roll of steel strip lying on its side. With this apparatus the pallets will usually be stacked the correct way up, i.e. with the product-bearing side uppermost.

Additional packing straps, for example made of steel, may be optionally used to further secure the product to the pallet once the pallet has been fitted to it.

Figure 3:
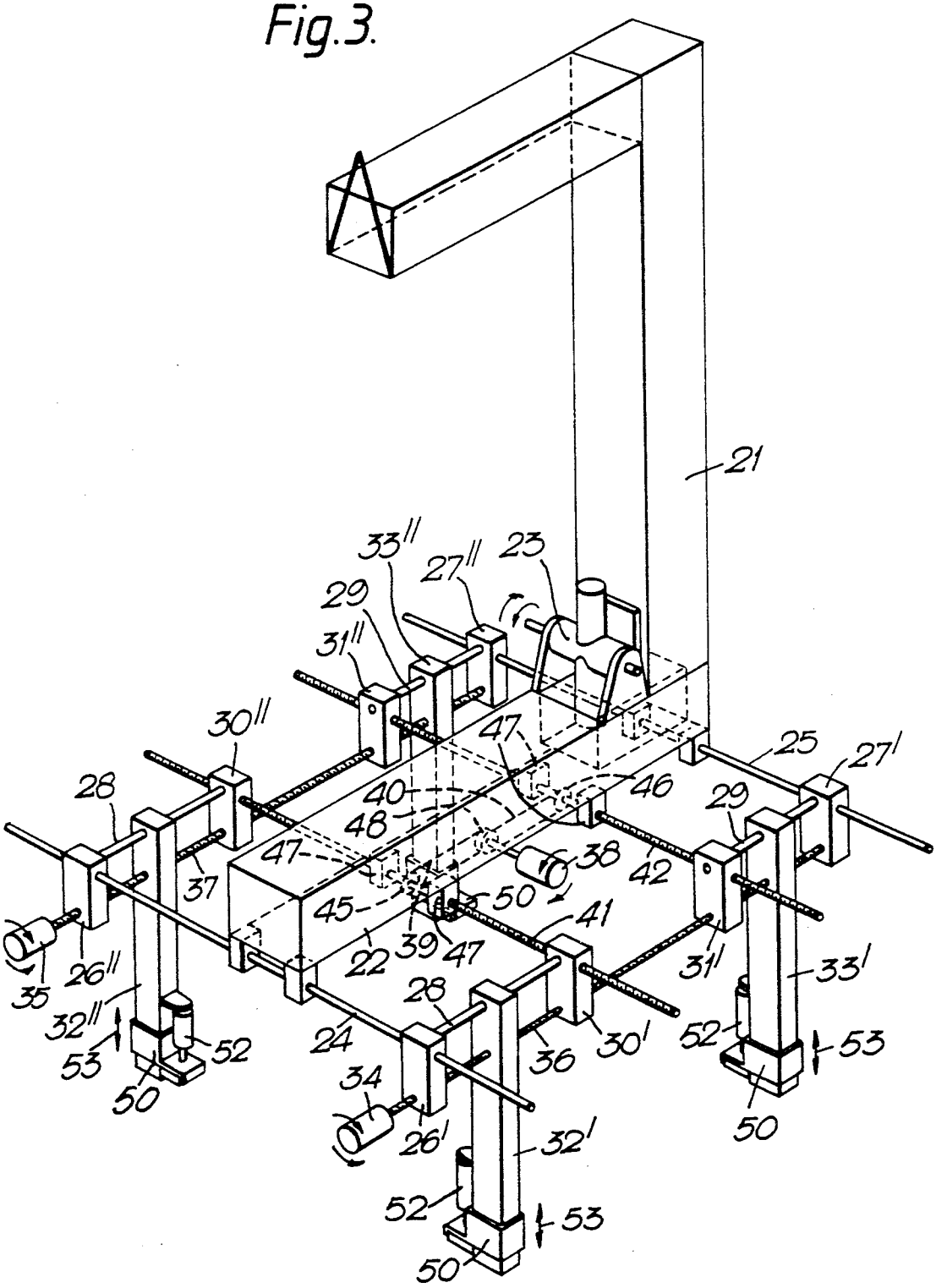
FIG. 3 shows in perspective the principal component parts of a second embodiment of the apparatus in accordance with the invention.

Referring now to FIG. 3, in which a second embodiment of the invention is illustrated, the lower bar 22 of a C-frame 21 can be angularly displaced by means of the motor drive 23. In its initial position for picking up a pallet from the top of a stack, the bar 22 is substantially horizontal. Attached to this lower bar 22 are slide bars 24 and 25 and connected thereto are, respectively, attachments 26′,26″ and 27′,27″ which are adapted to slide along the bars 24 and 25. The attachments 26′,26″,27′,27″ are connected to further slide bars 28 and 29. At the opposite ends of slide bars 28,29, i.e. at the ends opposite the attachments 26′,26″,27′,27″, are connected further attachments 30′,30″,31′,31″. Along slide bars 28,29 vertical legs 32″,33′,32″,33″ can move by means of actuating motors 34 and 35 which operate screw rods 36 and 37, respectively. Each screw bar 36,37 has two halves which are oppositely threaded, legs 32',32" being carried by for example the left hand threaded halves of the screw rods and the legs 33',33" being carried by the right hand threaded halves thereof. Thus, the legs 32' and 33' are moved towards or away from each other, depending upon the direction of rotation of the screw bar 36. The same goes for the vertical legs 32",33", which are movable by means of rotation of screw rod 37. Reference numeral 38 is a motor which, by means of drive chains 39,40 linking a two-gang pulley 48 with, respectively, pulleys 45 and 46, can operate screw bars 41 and 42. Each screw bar 41,42 is similarly reverse threaded on its two halves, so that attachments 30',30" and 31',31" move towards or away from each other depending on the direction of drive of the motor 38. In this manner, movement of legs 32',32",33',33" in both directions of the horizontal plane is possible, so that it is possible to properly adjust the legs to the dimensions of the pallet to be manipulated by the apparatus.

At the foot of each leg 32',32",33',33" is provided a clamping means 50 for engaging and clamping portions of the pallet. As seen from NL-A-8503583, the pallet may comprise a number of braces, e.g. extending inwardly from the periphery of the pallet, and these can provide convenient anchor points for the clamping means 50. Each clamping means 50 is movable in a vertical direction (indicated by arrows 53 in FIG. 3) along its respective leg, for example by means of actuation motors 52 (the motor on leg 33" is not shown in the figure, for clarity). The manner in which the clamping means 50 engage and clamp the pallet is not limited to any specific means. As an example, as shown in FIG. 3, each clamping means 50 comprises a vertically movable element which can exert a clamping action on a portion of the pallet positioned between it and a projecting foot on the end of each leg. Another possibility is the use of hinging hooks, as described in relation to the first embodiment of the invention.

Figure 4:
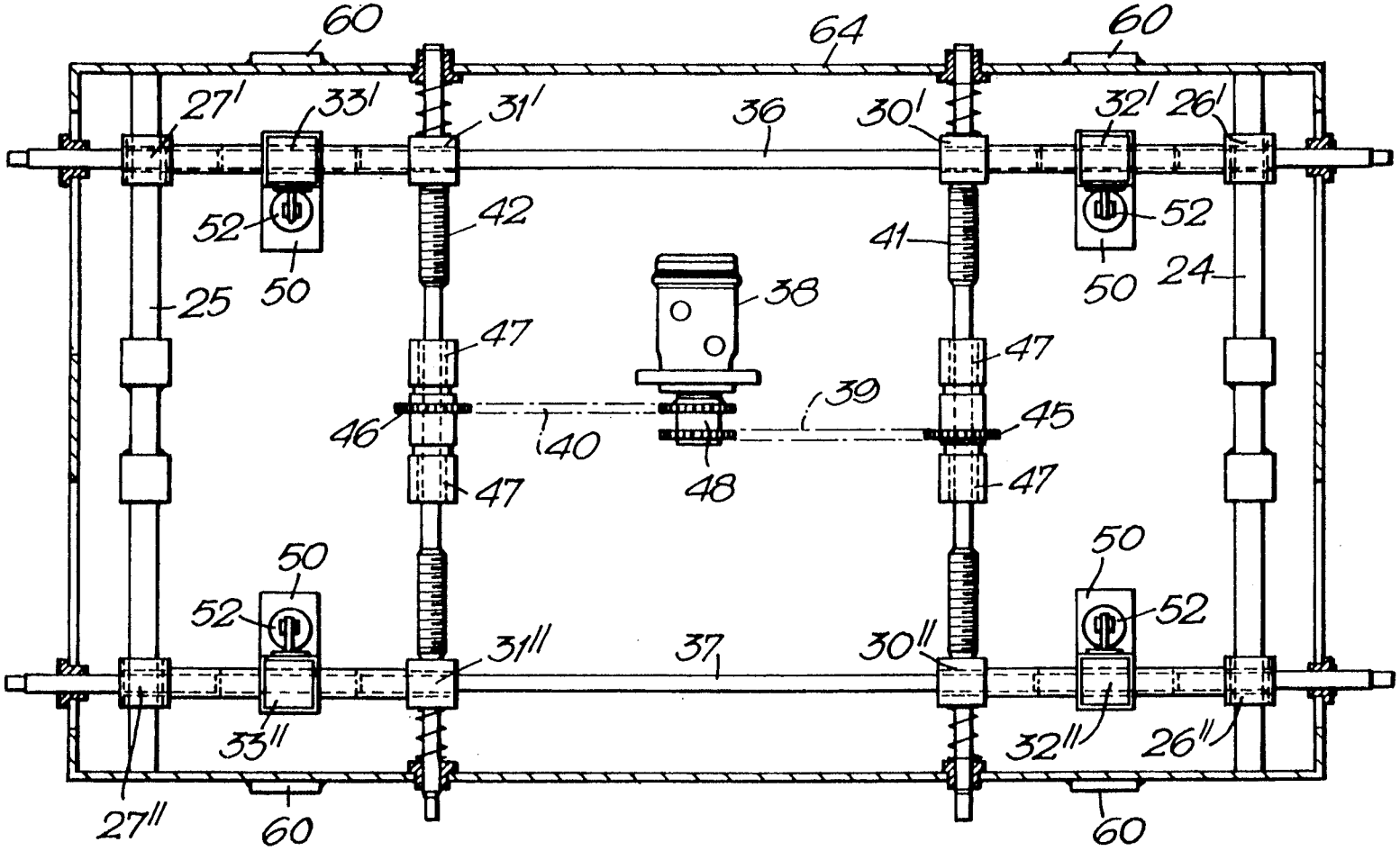
FIG. 4 is a part-sectional view of the apparatus of FIG. 3.
Figure 5:
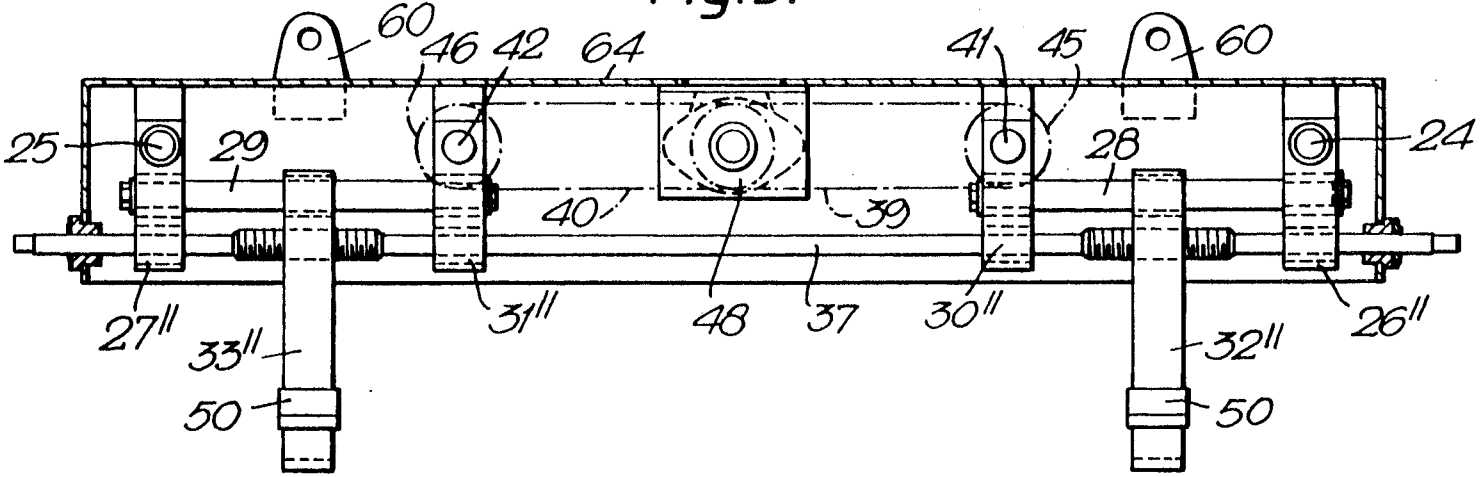
FIG. 5 is a side view of the apparatus of FIG. 3.
Figure 6:
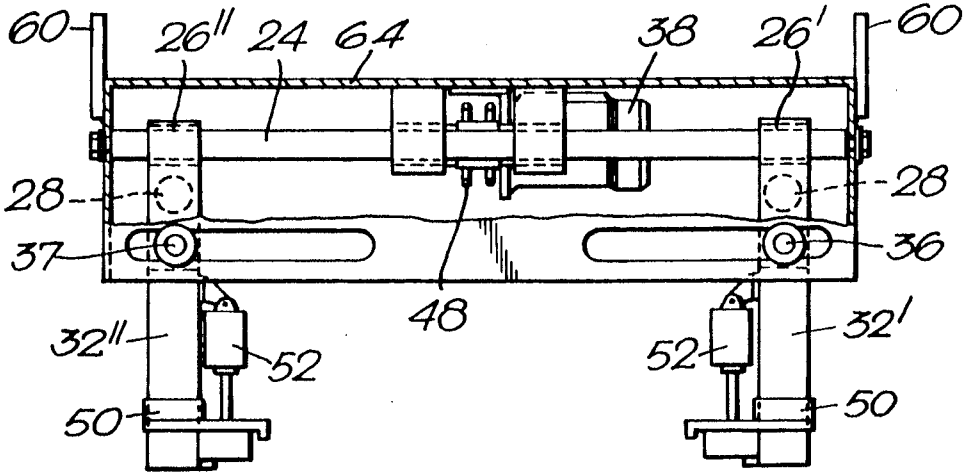
FIG. 6 is an end view of the apparatus of FIG. 3.

The apparatus described in relation to FIG. 3 is shown in further detail in FIGS. 4, 5 and 6. The components may be supported in a frame or box 64, which provides the necessary anchor points for the various screw rods and slide bars. Lugs 60 may be provided for attaching the coupling means to the remainder of the apparatus.

Figure 7:
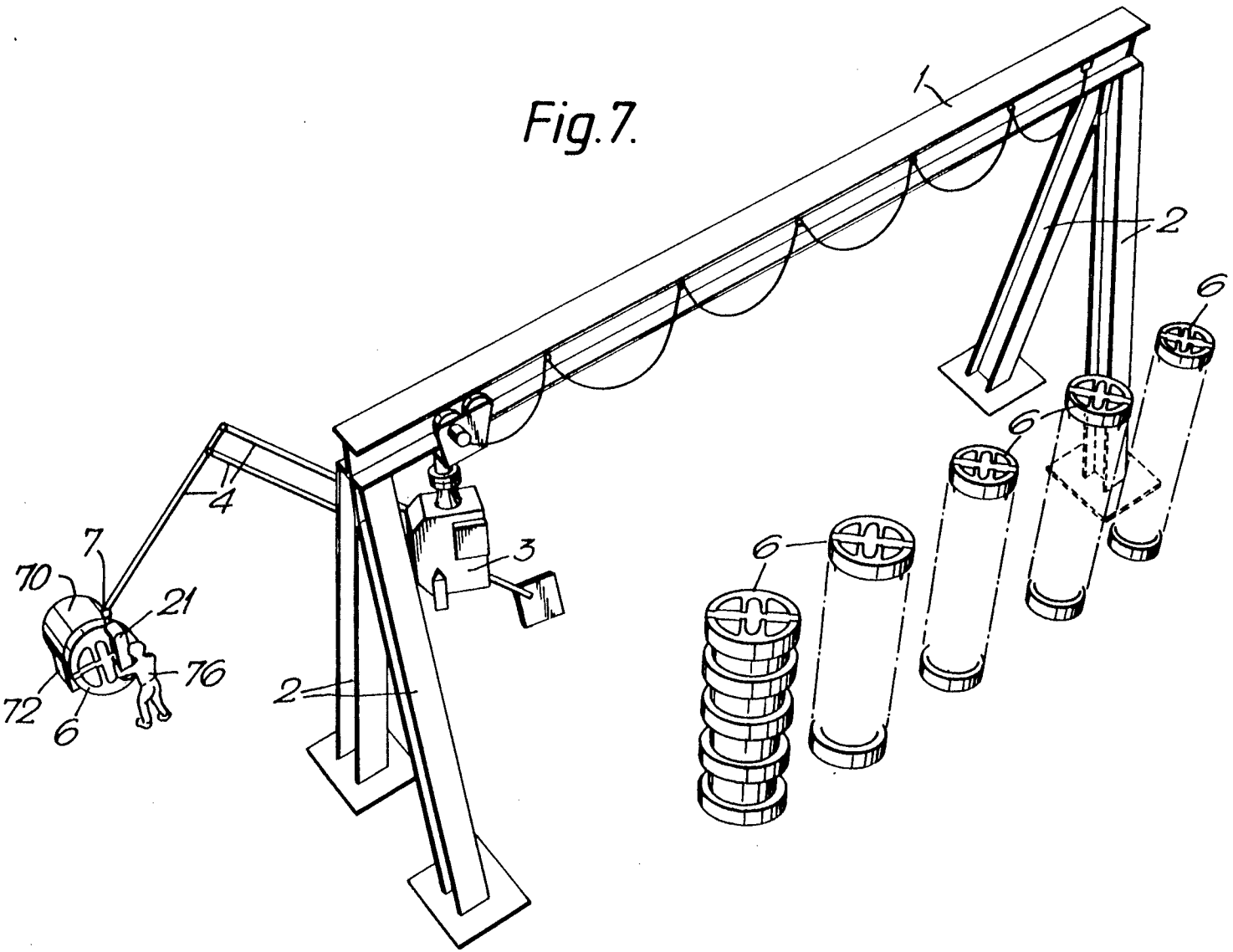
FIGS. 7 and 8 illustrate diagrammatically examples of systems for manipulating pallets comprising the apparatus of the invention.
Figure 8:
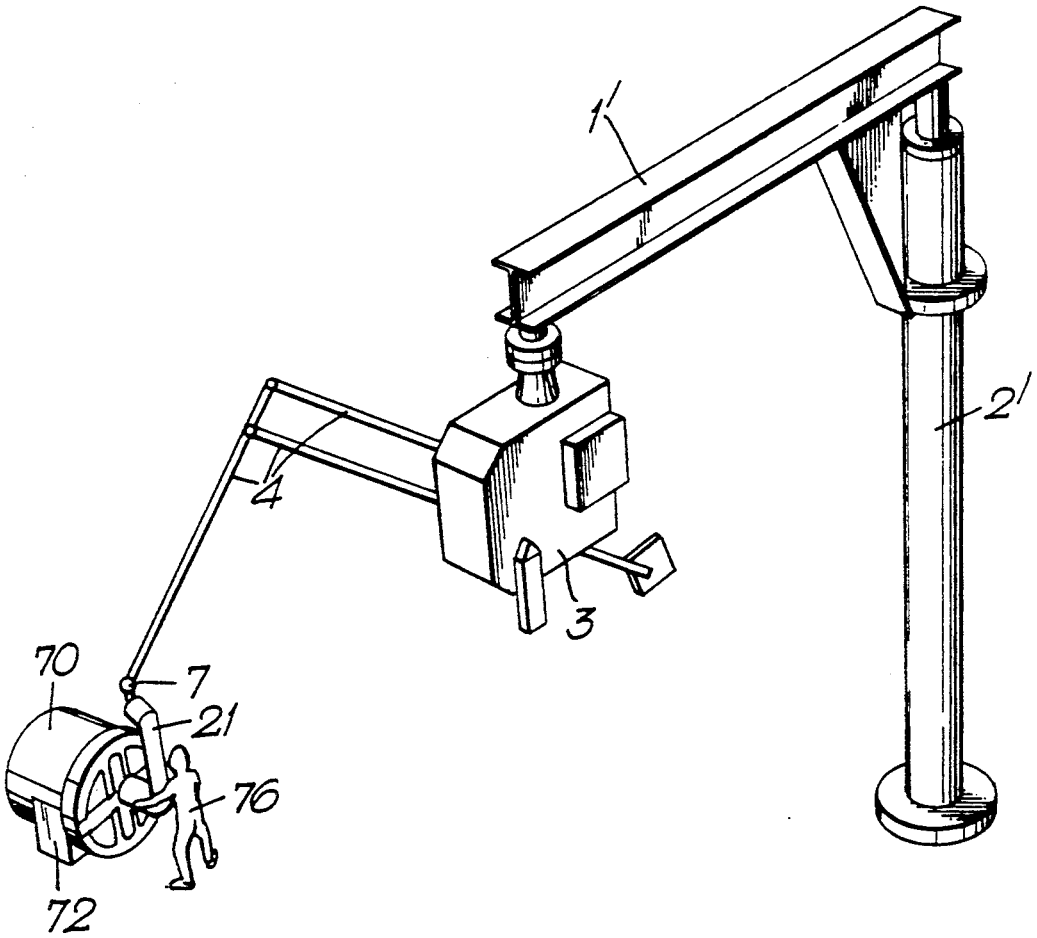

FIGS. 7 and 8 illustrate diagrammatically examples of systems for manipulating pallets utilising the apparatus of the invention. In FIG. 7 rail 1 is supported off the ground by means of uprights 2 and suspended from the rail 1 is a travelling car 3. Extending from the car 3 is a system of arms and legs 4, at the end of which is a hinging point 7 carrying a coupling means in accordance with the invention. The travelling car 3 and system of arms and legs 4 may take any suitable form, as is known in the art. FIG. 7 shows a human operator 76 operating the apparatus which has just picked up a pallet 6 so as to fit the pallet onto the end of a roll of product 70. In the figure the apparatus shown happens to be that of the second embodiment described above, but equally an apparatus in accordance with the first embodiment may be used. Product 70 is anchored in position on the ground during the fitting of the pallet to it by wedge 72.

FIG. 8 shows an apparatus much the same as that of FIG. 7, except here there is a single upright 2' and from its upper end there extends the rail 1'.

Although the present invention has been described with particular reference to pallets of the type described in NL-A-8503583, it is to be understood that the invention is applicable also to other types of pallet as will be evident to persons skilled in the art.

What is claimed is:

1. An apparatus for manipulating a two-part pallet, the pallet being adapted for supporting and carrying a product on first and second pallet parts to be secured together, wherein the apparatus includes means to horizontally position said two-part pallet, coupling means supported on said means for releasable engagement with the pallet, the coupling means comprising at least one pair of engagement members, each pair comprising first and second engagement members which are displaceable relative to each other along an axis, each first engagement member being provided with first clamping means for clamping a portion of the first pallet part and each second engagement member being provided with second clamping means for clamping a portion of the second pallet part, whereby actuation of the first clamping means on the first engagement member couples the first pallet part to the first engagement member and actuation of the second clamping means on the second engagement member couples the second pallet part to the second engagement member.

2. The apparatus according to claim 1, wherein each of the pallet parts of the pallet to be manipulated has at least one channel formed therein, each channel being adjacent the portion of the pallet part to be clamped by one of said first and second clamping means, and each pair of engagement members is formed by first and second portions of an elongate fork member, each fork member being extendable or retractable by relative displacement of the first and second portions thereof in mutually opposite directions along said axis, each fork member being adapted for insertion into said channel.

3. The apparatus according to claim 2, wherein there are two fork members spaced from each other and which are movable relative to each other in mutually opposite directions in a plane containing said axes.

4. The apparatus according to claim 2, wherein each first clamping means and each second clamping means are hooks which are engageable with respective portions of the first and second pallet parts, respectively, each hook being pivotable about a respective pivot carried by its respective engagement member, the pivoting of each hook being controllable by a respective pressure cylinder.

5. The apparatus according to claim 4, wherein each fork member is provided with enlargement portions adjacent each pivot for cooperating with a respective hook to increase the clamping action of the hook with the respective portion of the pallet part when the hook is pivoted.

6. The apparatus according to claim 2, wherein the fork member is movable in a direction substantially perpendicular to a plane containing said axis by means of a pneumatic pressure system.

7. The apparatus according to claim 1, wherein the first and second engagement members are legs which carry respectively said first and second clamping means, the first and second legs of each pair being movable relative to each other in mutually opposite directions along said axis.

8. The apparatus according to claim 7, wherein there are two pairs of legs, each pair being spaced from the other and movable relative to the other in mutually opposite directions in a plane containing said axis.

9. The apparatus according to claim 8, wherein means for effecting the relative movement of each pair of legs comprise at least one screw rod having two oppositely threaded portions, one of which portions carries the first pair of legs and the other of which portions carries the second pair of legs, each pair of legs being slidable along at least one slide bar, whereby rotation of the screw rod in a given direction causes the first and second pairs of legs to slide towards one another along their respective slide bar and rotation of the screw rod in an opposite direction causes the first and second pairs of legs to slide away from one another along their respective slide bar.

10. The apparatus according to claim 9, wherein the coupling means is supported on one bar of a C-frame, said bar being angularly displaceable with respect to the C-frame.

11. The apparatus according to claim 8, wherein the coupling means is supported on one bar of a C-frame, said bar being angularly displaceable with respect to the C-frame.

12. The apparatus according to claim 7, wherein means for effecting the relative movement of the first and second legs of each pair comprise at least one screw rod having two oppositely threaded portions, one of which portions carries the first leg and the other of which portions carries the second leg, each of the legs being slidable along a slide bar, whereby rotation of the screw rod in a given direction causes the first and second legs to slide towards one another along their respective slide bar and rotation of the screw rod in an opposite direction causes the first and second legs to slide away from one another along their respective slide bar.

13. The apparatus according to claim 12, wherein the coupling means is supported on one bar of a C-frame, said bar being angularly displaceable with respect to the C-frame.

14. The apparatus according to claim 7, wherein the coupling means is supported on one bar of a C-frame, said bar being angularly displaceable with respect to the C-frame.

15. The apparatus according to claim 1, wherein the coupling means is carried on a manipulation arm, the arm being movable in substantially any direction.

16. A method of manipulating a pallet which comprises first and second pallet parts to be secured together and applying the pallet to a product to be supported and carried comprising bringing coupling means into engagement with said pallet parts and actuating first and second clamping means to clamp a first pallet part to a first engagement member of said clamping means and a second pallet part to a second engagement member of said coupling means, applying said pallet held by the coupling means to the product to be supported, and displacing said first and second engagement members of each pair relative to each other to engage the product.

* * * * *